US006892942B1

(12) United States Patent
Widl et al.

(10) Patent No.: US 6,892,942 B1
(45) Date of Patent: May 17, 2005

(54) ROADSIDE CONTROL DEVICE FOR A TOLL APPARATUS INSTALLED IN A MOTOR VEHICLE

(75) Inventors: Andreas Widl, München (DE); Ronald Barker, München (DE)

(73) Assignee: Vodafone Holding GmbH, Düsseldorf (DE)

( * ) Notice: Subject to any disclaimer, the term of this patent is extended or adjusted under 35 U.S.C. 154(b) by 0 days.

(21) Appl. No.: 09/719,933

(22) PCT Filed: May 26, 1999

(86) PCT No.: PCT/DE99/01586

§ 371 (c)(1),
(2), (4) Date: Feb. 12, 2001

(87) PCT Pub. No.: WO99/66455

PCT Pub. Date: Dec. 23, 1999

(30) Foreign Application Priority Data

Jun. 18, 1998 (DE) ..... 198 28 913

(51) Int. Cl.[7] ..... G07B 15/02

(52) U.S. Cl. ..... 235/384; 235/379; 235/380; 235/472.02

(58) Field of Search ..... 235/384, 379–380, 235/472.02

(56) References Cited

U.S. PATENT DOCUMENTS 5,204,675 A * 4/1993 Sekine ..... 340/933
5,440,109 A * 8/1995 Hering et al. ..... 235/384
5,717,390 A * 2/1998 Hasselbring ..... 340/933
5,767,505 A * 6/1998 Mertens et al. ..... 235/61 S
5,859,415 A * 1/1999 Blomqvist et al. ..... 235/384

FOREIGN PATENT DOCUMENTS

GB 2295476 A * 5/1996 ..... G07B/15/00

OTHER PUBLICATIONS

Rokitansky et al. ("Methods and tools for performance evaluation and validation of vehicle–roadside communications proposed for standardization", Vehicular Technology Conference, 1995 IEEE 45th, vol.: 2, Jul. 25–28, 1995, Pages(s): 964–970 vol.2).*

* cited by examiner

*Primary Examiner*—Michael G. Lee
*Assistant Examiner*—Seung H Lee
(74) *Attorney, Agent, or Firm*—Cohen, Pontani, Lieberman & Pavane

(57) ABSTRACT

A roadside control device for checking the correct operation of a toll apparatus which is installed in a motor vehicle passing the control device and exhibiting an identifying license plate. The toll apparatus performs a satellite-supported electronic toll deduction and being equipped with the following facilities:

a) a communication device,
b) a classification device,
c) a trigger device,
d) an evaluating device, and
e) a recording device.

20 Claims, 1 Drawing Sheet

ROADSIDE CONTROL DEVICE FOR A TOLL APPARATUS INSTALLED IN A MOTOR VEHICLE

PRIORITY CLAIM

This is a U.S. national stage of application No. PCT/DE99/01586, filed on May 26, 1999. Priority is claimed on that application and on the following application Country: Germany, Application No.: 198 28 913.8, Filed: Jun. 18, 1998.

BACKGROUND OF THE INVENTION

1. Field of the Invention

The invention relates to a roadside control device for checking the correct operation of a toll apparatus which is installed in a motor vehicle passing the control device and exhibiting an identifying license plate, the toll apparatus performing a satellite-supported electronic toll deduction.

2. Discussion of the Prior Art

From EP 0 691 013 B1, the content of disclosure of which is included in the present application by reference, an electronic deduction system is known by means of which utilization charges can be collected from vehicles which move through a predetermined geographic zone or a chargeable road distance (utilization charges=toll). The known system provides that in each motor vehicle, a toll apparatus is installed which has a receiver for the signals of a navigation satellite system such as, e.g., GPS (Global Positioning System) or Glosnar and is provided with an electronic memory in which the chargeable road distances and the geographic zones (in the text which follows, only chargeable roads or road distances are mentioned, to simplify matters) and the respectively associated utilization tariffs are listed. Using the signals of the navigation satellite system, the toll apparatus has access to the current geographic position of the vehicle at any time and recognizes from the stored data concerning the chargeable road distances whether the motor vehicle is on a chargeable road distance or not and can automatically determine the toll amounts which may be due in this manner. To ensure completely anonymous deduction of the toll amounts, the known system provides for the use of debit cards (e.g. chip card) on which the respectively due toll amounts are deducted by the toll apparatus.

However, this method of collecting the toll amounts, which can be carried out with comparatively little expenditure, in principle opens up a number of possibilities for deception by the operator of the respective vehicle. Suitable precautions for detecting corresponding actions of misuse are therefore mandatory.

From EP 0 701 722 B1, a toll apparatus is known which exhibits for this purpose a device for self monitoring for unauthorized manipulations at the individual components of the toll apparatus and an error memory for recording diagnostic data in the case of an unauthorized manipulation. If an unauthorized manipulation occurs, the toll apparatus can send out a signal indicating the improper operation of the apparatus via a corresponding signal device.

Naturally, this presupposes that the apparatus itself is switched on and that the signal device has not been switched off or otherwise manipulated.

Furthermore, from EP 0 700 561, a toll apparatus is known which has a signal device via which diagnostic data which provide information on the operability of the toll apparatus or of its individual components, respectively, can be interrogated wirelessly from the outside. Using the transmitted diagnostic data, it should be possible to determine both non-payers and wrong payers who pay for their road utilization in a wrong class of charges. This document does not provide more detailed information on the external monitoring devices which are intended to determine and trace the road misuse.

From GB 2 295 476 A, a roadside control device for checking the correct operation of a toll apparatus which is installed in a motor vehicle passing the control device and exhibiting an identifying license plate is known, wherein the toll apparatus performs a satellite-supported electronic toll deduction. For this purpose, the control device exhibits a communication device for the wireless exchange of information between the control device and the toll apparatus in the passing vehicle. The toll apparatus is capable of determining toll amounts by means of time-dependent utilization tariffs and of deducting these amounts electronically from a credit value stored in an accompanying credit card. When a motor vehicle passes the control device, the facilities of the control device are activated by the triggering of a corresponding signal of an optical sensor. The communication device of the control device transmits to the vehicle which is just passing a data inquiry which must be answered within a predetermined time. The response of the vehicle is then checked by the control device for the presence of an error code. An error code is stored by the toll apparatus if the enforcement light visible to the outside is damaged, if the credit value in the storage card becomes negative and if the antenna of the communication device has been shielded over a certain period of time and thus was not ready to receive. If no error code is detected, the control device assumes that the toll apparatus is working correctly. If, on the other hand, an error code is detected or no dialog can be established between the passing vehicle and the control device, a camera is activated which takes a photograph of the vehicle.

Finally, U.S. Pat. No. 5,767,505 also discloses a roadside control device for operating a toll apparatus in motor vehicles which pass the control device. The toll apparatus performs a satellite-supported electronic toll deduction. In this process, single amounts are deducted whenever the vehicle has passed a virtual toll station, the position data of which are stored in the toll apparatus. In addition, the toll apparatus also has the position data of control stations and when these are being passed, it automatically transmits certain control data to a central station by means of digital mobile radio. Cameras installed at the control station record all passing vehicles and their license plates and forward this information to the central station. At this station, the images are evaluated and compared with the control data in each case transmitted by the vehicle, the content of which data is not explained in greater detail. If there is no correlation between the data compared, then a report is generated in the central station in order to pursue the matter further manually. If there is correlation, then the data transmitted to the central station are deleted.

SUMMARY OF THE INVENTION

It is, therefore, the object of the present invention to provide a roadside control device for checking the correct operation of a toll apparatus for satellite-supported electronic toll deduction which, on the one hand, ensures a high success rate during the checks to be performed but, on the other hand, requires the least possible expenditure for the apparatus technology and the operation of the control device.

According to the invention, the control device has at least the following facilities:

a) a communication device for the wireless exchange of information between the control device and the toll apparatus in the passing vehicle, b) a classification device for allocating the passing vehicle to a predetermined vehicle class, c) a trigger device for the accurately timed activation of the devices of the control device, d) an evaluating device for a plausibility check of the data supplied by the communication device and the classification device from the and on passing vehicle (or its toll apparatus, respectively), and e) a recording device for recording the license plate of the passing vehicle in the case of an unsuccessful exchange of information of the communication device with the toll device of the passing vehicle or in the case of a negative result of the plausibility check of the evaluating device.

The invention thus provides a control device which can handle the required roadside surveillance of the passing vehicle virtually automatically. Via the communication device, the control device can wirelessly request the toll apparatus of the vehicle passing in each case to transmit information on the current operating state of the toll apparatus.

In particular, such information contains details on the vehicle class used as a basis for the charge deduction and on the proper booking of the toll amounts, for instance on a debit card or alternatively via the correct transmission of the toll amounts to a charge deduction center. The communication device is preferably constructed as a dedicated short-range communication (DSRC) device for the frequency range from 2.4 to 5.8 GHz. It can also be appropriate to use a terminal for a cellular network (CN) or a data radio network as the communication device. Such a terminal is of advantage especially if it is suitable for digital mobile radio and corresponds, e.g., to the GSM standard. A terminal for the Mobitex system can also be advantageously used. In principle, it is also possible to use a communication device in which the information is transmitted via infrared or ultrasonic signals. However, optical transmission methods are less preferred due to their sensitivity to physical obstructions on the transmission path. It is also recommended to conduct the dialog between the control device and the toll apparatus of the respective motor vehicle in encrypted form. For this purpose, corresponding encryption and decryption components must be provided in the control device and in the motor vehicle or, respectively, the toll apparatus of the motor vehicle. This distinctly increases the security against manipulation. In the vehicle, the keys necessary for encryption can be stored, for example, in a chip card or a fixed memory of the toll apparatus or of the communication device used in the motor vehicle. A particularly effective protection against manipulation can also be guaranteed if, apart from the current charge and chip card information, satellite, position and/or other apparatus information is interrogated and transmitted to the control device. If the roadside control device is equipped with a receiver for the signals of the navigation satellite system used, in a corresponding manner to the vehicle-mounted toll apparatus, the satellite signals currently received at the vehicle can be compared, for example, with the satellite signals currently received by the roadside control device. In this manner, confusions with other vehicles which are passing the roadside control device at the same time or very closely in time, and data manipulation can be virtually eliminated. This correspondingly also applies if the passing vehicle provides direct information on its current position at the time of the dialog.

If necessary, information for police purposes which goes beyond the pure monthly deduction can also be transmitted from the vehicle (e.g. driving times of a lorry driver or vehicle data which could be read out via a CAN bus).

A particularly significant part of the roadside control device is the classification device which suitably also operates in accordance with an acoustic or optical measuring principle. It has the task of recognizing the respective type of the passing vehicle by means of characteristic signals, with such an accuracy that it can be unambiguously allocated to a certain class of charges with the greatest reliability. With respect to acoustic measuring principles, the noises emitted by a motor vehicle can be analyzed, for example. Thus, a goods vehicle (truck or bus) has a distinctly different frequency spectrum from a passenger car or a motorcycle. From ultrasonic signals, for example, information can be derived which can be used for determining the size of a vehicle in order to be able to perform a class allocation in this manner. In general, a number of different measuring methods can also be combined with one another in order to increase the reliability of the allocation. In the context of the present invention, optical measuring methods are particularly preferred. In a preferred embodiment, the classification device therefore has a sensor arrangement which exhibits an electronic image sensor. This image sensor provides for the electronic recording of images of the respective vehicle which can then be compared with stored images from a vehicle class database. The allocation to a vehicle class is in each case performed in accordance with the greatest match in the image features. To reduce the computing effort for such a comparison method and to shorten the time required, it is particularly appropriate if the classification device operates in accordance with the principle of optical correlation. In this case, it is not the image information but the spatial frequencies of the images which are optically superimposed and through which a light source is vertically shone. The intensity of the transmitter to light is a direct measure of the correlation of the images and thus of the class of vehicle. The vehicle class could also be determined by means of the heat distribution over the length of the vehicle, for example, with the aid of an infrared image sensor, e.g. by means of a microbolometer array. Another alternative can be seen in the allocation of the vehicles passing the control device by means of a geometric vehicle surveillance by means of infra-red detectors. However, this type of vehicle classification is comparatively very complex and, as a rule, requires the installation of the control device on a bridge above the roadway to be observed.

The central component of the control device according to the invention is a trigger device which appropriately activates the various devices and components of the control device and also determines the time sequence of the vehicle classification. The trigger device detects the time at which a motor vehicle has reached a defined position on the roadway or a defined distance from the control device and, if necessary, also provides, e.g., additional information on the respective vehicle speed. The trigger device suitably has an electronic image sensor followed by image processing. As an alternative, a radar sensor or a laser sensor can also be provided. Naturally, it is also possible to combine a number of different sensors.

The evaluating device has the task of determining whether the vehicle checked is legally driving on the road or not, i.e. whether the due road usage charges are correctly determined and deducted in accordance with the relevant tariff in each case by the toll apparatus in the vehicle. For this purpose, the information which is supplied, on the one hand, via the dialog with the toll apparatus and, on the other hand, by the classification device is compared and checked for plausibility. If the vehicle class interrogated from the toll apparatus of the motor vehicle, for example by radio via the communication device, deviates from the vehicle class determined by the classification device, the evaluating device supplies a signal which initiates further measures in order to pursue the probable violation of the law. Instead of a deceptive manipulation, a technical fault may also be present. The most important measure consists in securing evidence which provides for a reliable proof that the vehicle observed in each case has indisputably not performed a correct calculation and further debiting of the road usage charge due in each case.

For this purpose, a recording device is provided which produces, in the event of a negative result of the plausibility check or in the event that no dialog with the vehicle or, respectively, the toll apparatus of the vehicle has been set up at all, a recording of the vehicle by means of which this vehicle can be unambiguously identified. Naturally, the recording of the license plate of the vehicle is primarily suitable for this purpose. Such a recording device can comprise, for example, an electronic camera. In this arrangement, it is also possible for the electronic camera of the recording device to be physically identical with an electronic camera which forms the sensor system of the classification device so that the expenditure for this component can be saved. The time at which the recording of the license plate is taken is predetermined by a corresponding signal by the trigger device.

It is particularly advantageous if the control device comprises a radio device, especially a data radio device, via which, in the case of an improper operation of the toll apparatus in the vehicle which has been detected by the evaluating device, the recording of the license plate of the vehicle affected and, as far as necessary, further data of the respective checking process can be transmitted to a control center. In this connection, it is also appropriate if the control device has a data compression device so that the data can be transmitted to the control center in compressed form. This makes it possible to distinctly reduce the capacity requirements for the transmission channels, and thus the costs of the data transmission.

The control device according to the invention essentially consists of electronic components which require little constructional volume and have low energy consumption. This control device can, therefore, be produced as a compact equipment unit. It can be installed at fixed locations. e.g. on a mast used as equipment support, or on a bridge leading over the respective road. However, the installation in a vehicle is particularly advantageous with respect to the effectiveness of control processes which are carried out as spot checks, so that the control device can be used as a mobile device at any locations. This has the advantage, on the one hand, that a single apparatus can be used for serving a multiplicity of control points and that, on the other hand, the users of the chargeable road distances cannot adjust to control points known in advance in order to remain undetected as "fare dodgers", for example, by always performing a correct operation of the toll apparatus in time before reaching such control points while the toll apparatus is, for example, simply switched off otherwise. A particularly high level of flexibility in use and control effectiveness can be achieved if the control device is constructed in such a compact manner that it can be used as a hand apparatus (similar to a "radar gun" used for speed checking).

The present invention makes it possible to perform a check of the correct operation of satellite-supported toll apparatuses in spot-check or also continuous form with comparatively low expenditure for the construction and operation of a roadside control device, in which arrangement a very high reliability with respect to the factual correctness of the control processes performed can be achieved. The essential factor is that the personnel expenditure necessary for this is extremely low since the control cycles occur virtually in fully automated form.

BRIEF DESCRIPTION OF THE DRAWINGS

In the text which follows, the present invention will be explained in greater detail by way of an example with reference to the diagrammatic representations shown in the two figures, in which.

DETAILED DESCRIPTION OF THE PREFERRED EMBODIMENTS

Figure 1:
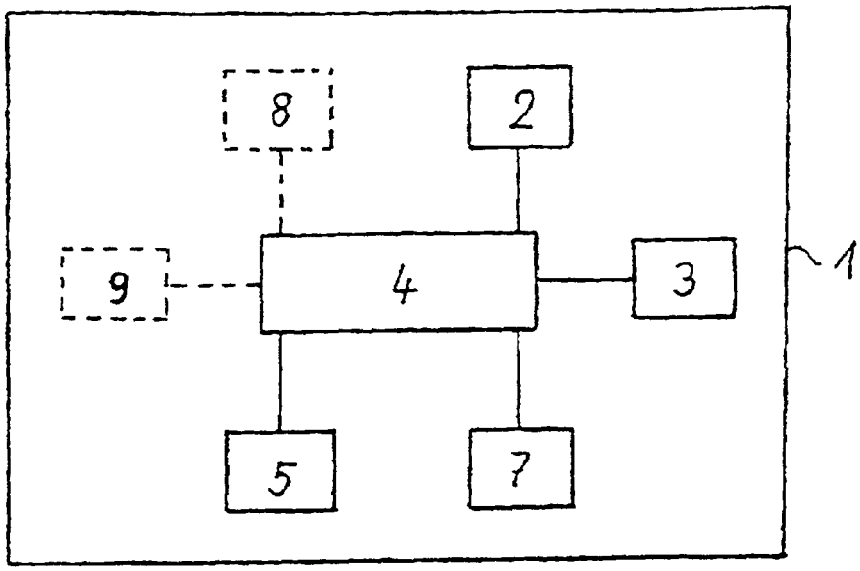
FIG. 1 shows a block diagram of a control device according to the invention.

The control device 1 shown in the form of function blocks in FIG. 1 exhibits a communication device 2 which, for example, is constructed as a dedicated short-range communication device for a frequency in the region of 5.8 GHz. The control device 1 also comprises a classification device 3, the sensor system of which contains an electronic image sensor (e.g. in the form of an electronic camera). The control device 1 also has a trigger device 4 which is connected to the communication device 2 and the classification device 3 for signals. In addition, an evaluating device 5 and a recording device 7 are connected for signals to the trigger device 4. The evaluating device 5 consists, e.g., of an electronic computer which performs a plausibility check with regard to the vehicle class of the vehicle currently being checked and passing the control device 1. For this purpose, this computer compares relevant information which is obtained from the checked vehicle or, respectively, from its toll apparatus via the communication device 2, with the corresponding information on the passing vehicle which has been determined by the control device itself in order to be able to specify the relevant vehicle class. If the evaluating device 5 finds that the vehicle class used in the toll apparatus in the vehicle is different from the vehicle class determined by the control device 1 itself, a signal is generated which is representative of the state that the vehicle currently passing is not performing a correct deduction of the road usage charges. A corresponding signal is then output via the trigger device 4 to the recording device 7 in order to make a recording which identifies the vehicle affected. This recording device 7 is constructed, for example, as an electronic camera. At the same time, this can advantageously also be used as sensor system for the classification device 3.

A GPS receiver 8, by means of which signals of the navigation satellite system used by the toll apparatus in the vehicle can be received, and a radio device 9 constructed, e.g., as a data radio device, by means of which the recording made of the vehicle or, respectively, of its license plate, together with other information on the detected occurrence can be transmitted wirelessly to a control center, are appropriate, but not mandatorily required, for the operation of the control device 1 according to the invention. After the transmission, this control center then has reliable evidence on the basis of which the detected violation of the law by the driver of the respective vehicle can be pursued. The authenticity of the interrogated data can be completely guaranteed by means of the information of the GPS receiver 8 which can be compared with corresponding GPS information which is interrogated from the vehicle by the control device 1.

Figure 2:
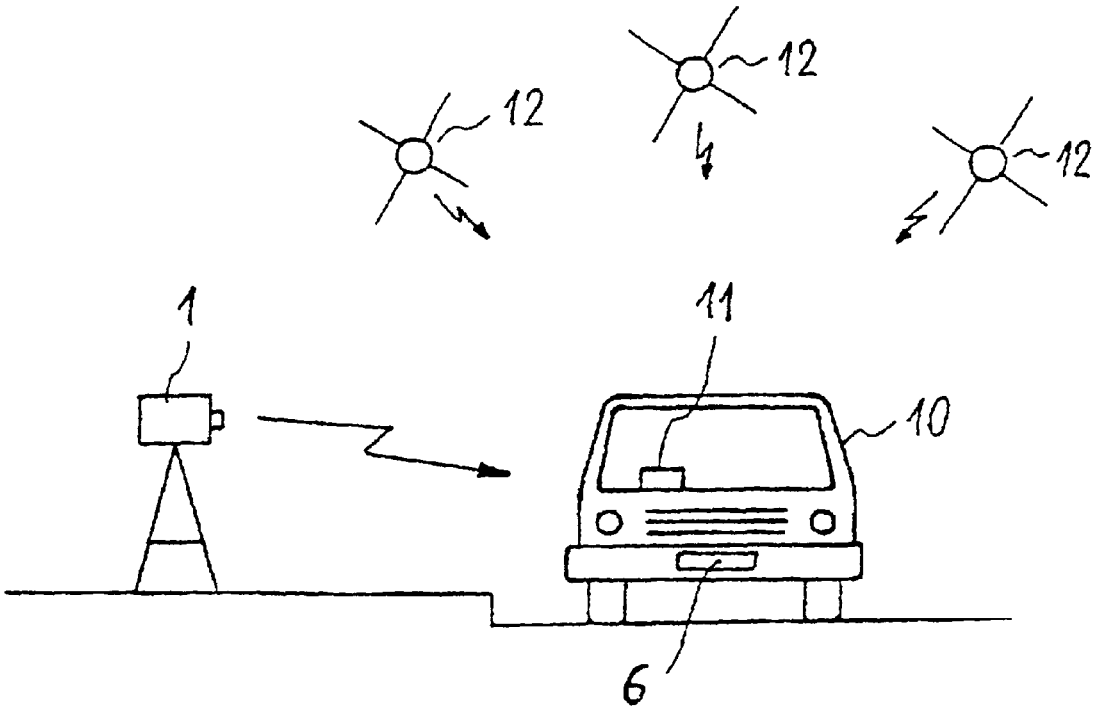
FIG. 2 shows a diagrammatic representation of a control device installed by the roadside.

FIG. 2 diagrammatically shows the process of a check by the control device 1. A motor vehicle 10 which is equipped with a toll apparatus 11 and carries a license plate 6 identifying the vehicle is driving on a chargeable road. Next to the road, the control device 1 according to the invention is set up on a mobile stand. The reference symbol 12 represents three satellites of a navigation satellite system which send out signals by means of which an accurate two-dimensional determination of the location of the respective GPS receiver, and thus of the vehicle position, is possible. The control device 1, which, naturally, could also be installed in a vehicle which is parked by the roadside, addresses the toll apparatus 11 by its dedicated short-range communication device and interrogates the data required for determining the correctness of the operation of the toll apparatus 11. As soon as the control device 1 detects a motor vehicle 10 in which the plausibility check with regard to the correctness leads to a negative result, an evidence-securing recording of the vehicle 10, preferably of its license plate 6, is made via the recording unit, not shown in greater detail in FIG. 2, and transmitted to a control center for pursuing the detected violation of the law, e.g. via a radio device not shown in greater detail in FIG. 2. The relevant vehicle can then be pulled out of the traffic by the police at a suitable location (e.g. at a parking spot or a service area) and the relevant driver can be confronted with the evidence. At this location, it is then possible to determine whether the improper operation of the toll apparatus 11 is based on a manipulation or on a technical failure of the toll apparatus 11 which would not have to be defended by the driver of the vehicle 10.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A roadside control device for checking correct operation of a toll apparatus which is installed in a motor vehicle passing the control device and exhibiting an identifying license plate, the toll apparatus performing a satellite-supported electronic toll deduction, the control device comprising:

a) communication means for wirelessly exchanging information with the toll apparatus in the passing vehicle, the information being pertinent to a current operating state of the toll apparatus;

b) classification means for allocating the passing vehicle to a predetermined vehicle class;

c) evaluating means for carrying out a plausibility check to determine whether the information received from the toll apparatus of the passing vehicle by the communication means comports with the vehicle class to which the passing vehicle is allocated by the classification means;

d) recording means for recording the license plate of the passing vehicle in case of an unsuccessful exchange of information of the communication means with the toll apparatus of the passing vehicle or in case of a negative result of the plausibility check of the evaluating means; and e) trigger means for accurately timed activation of the communication means, the classification means, the evaluating means, and the recording means.

2. A control device as defined in claim 1, wherein the communication means includes a dedicated short-range communication (DSRC) device.

3. A control device as defined in claim 2, wherein the communication means is a radio device for a frequency range from 2.4 to 5.8 GHz.

4. A control device as defined in claim 1, wherein the communication means is a terminal for one of a cellular network (CN) and a data radio network.

5. A control device as defined in claim 1, wherein the communication means is operative to conduct a dialog with the motor vehicle in encrypted form.

6. A control device as defined in claim 1, wherein the classification means includes a sensor system which operates in accordance with one of an acoustic principle and an optical measuring principle.

7. A control device as defined in claim 6, wherein the sensor classification means includes an electronic image sensor.

8. A control device as defined in claim 7, wherein the classification means operates in accordance with an optical correlation principle.

9. A control device as defined in claims 1, wherein the trigger means includes an image sensor followed by image processing.

10. A control device as defined in claims 1, wherein the trigger means includes a radar sensor.

11. A control device as defined in claims 1, wherein the trigger means includes a laser sensor.

12. A control device as defined in claims 1, wherein the evaluating means is operative to compare the vehicle class transmitted by the toll apparatus of the motor vehicle via the communication means with the vehicle class determined by the classification means.

13. A control device as defined in claims 1, wherein the recording means includes an electronic camera.

14. A control device as defined in claims 13, wherein the classification means includes a sensor system including an electronic camera, the electronic camera of the recording device being physically identical to the electronic camera of the sensor system of the classification means.

15. A control device as defined in claims 1, and further comprising a receiver for the satellite navigation system used by the toll apparatus, the evaluating means being operative to compare data determined by itself with data of the satellite navigation system interrogated from the toll apparatus, which data can be conducted to the evaluating means via the communication means.

16. A control device as defined in claim 1, and further comprising a radio device via which a recording of the license plate of the motor vehicle can be transmitted to a control center in case of improper operation of the toll apparatus found by the evaluating means.

17. A control device as defined in claim 16, and further comprising data compression means for transmitting data to the control center in compressed form.

18. A control device as defined in claim 1, wherein the control device is mountable on one of a mast and a bridge construction which extends over a road on which the motor vehicle is driving.

19. A control device as defined in claim 1, wherein the control device is arrangeable in a vehicle parked next to a road on which the motor vehicle is driving.

20. A method for detecting correctness of operation of a satellite-supported electronic toll apparatus in a vehicle and for securing evidence in case of improper operation of the toll apparatus, comprising the steps of:

wirelessly exchanging information between a control device and the toll apparatus in the passing vehicle using communication means of the control device, the information being pertinent to a current operating state of the toll apparatus;

allocating the passing vehicle to a predetermined vehicle class using classification means of the control device;

carrying out a plausibility check in evaluating means of the control device to determine whether the information received from the toll apparatus of the passing vehicle by the communication means comports with the vehicle class to which the passing vehicle is allocated by the classification means;

recording the license plate of the passing vehicle in case of an unsuccessful exchange of information of the communication means with the toll apparatus of the passing vehicle or in case of a negative result of the plausibility check of the evaluating mean; and activating the communication means, the classification means, the evaluation means and the recording step in an accurately timed fashion.

* * * * *